US005893227A

United States Patent [19]

Johansson et al.

[11] Patent Number: 5,893,227

[45] Date of Patent: Apr. 13, 1999

[54] FABRIC SIGN WITH TENSIONING MEANS

[76] Inventors: Göran Johansson, Måns Smeds Väg 12, S-665 34, Kil; Patrik Johansson, Strands Tvärgata 3, S-653 41, Karlstad, both of Sweden

[21] Appl. No.: 08/793,195

[22] PCT Filed: Aug. 24, 1995

[86] PCT No.: PCT/SE95/00957

§ 371 Date: Feb. 20, 1997

§ 102(e) Date: Feb. 20, 1997

[87] PCT Pub. No.: WO96/07172

PCT Pub. Date: Mar. 7, 1996

[30] Foreign Application Priority Data

Aug. 29, 1994 [SE] Sweden ..... 9402859

[51] Int. Cl.[6] ..... G09F 17/00

[52] U.S. Cl. ..... 40/603; 160/328

[58] Field of Search ..... 40/603; 160/328, 160/391, 395

[56] References Cited

U.S. PATENT DOCUMENTS

| | | | |
|---|---|---|---|
| 3,719,013 | 3/1973 | Blick | 160/395 X |
| 3,833,046 | 9/1974 | Tombu | 160/395 X |
| 4,265,039 | 5/1981 | Brooks . | |
| 4,798,356 | 1/1989 | Alonso | 40/603 X |
| 4,817,317 | 4/1989 | Kovalak, Jr. | 40/603 |
| 4,937,961 | 7/1990 | Gandy et al. . | |
| 5,020,254 | 6/1991 | Sheppard | 40/603 |
| 5,033,216 | 7/1991 | Gandy et al. . | |
| 5,058,652 | 10/1991 | Wheatley et al. | 160/328 X |
| 5,239,765 | 8/1993 | Opdahl | 40/603 |
| 5,255,459 | 10/1993 | Verret | 40/603 |
| 5,572,821 | 11/1996 | Coleman | 40/603 |
| 5,678,338 | 10/1997 | Coleman | 40/603 |

FOREIGN PATENT DOCUMENTS

| | | |
|---|---|---|
| 0114453 | 8/1984 | European Pat. Off. . |
| 268308 | 5/1988 | European Pat. Off. . |
| 0495688 | 7/1992 | European Pat. Off. . |
| 0503705 | 9/1992 | European Pat. Off. . |
| 2226175 | 6/1990 | United Kingdom . |

*Primary Examiner*—Brian K. Green
*Assistant Examiner*—Andrea Chop
*Attorney, Agent, or Firm*—Nixon & Vanderhye P.C.

[57] ABSTRACT

A sign with a fabric, a frame profile and a clamping profile for a bar around which an edge portion of the fabric is wrapped. The frame profile is provided with a counter support forming a center of a pivot for the clamping profile. The clamping profile has a flange defining an assembly pocket for the bar with the edge portion of the fabric wrapped around it, and a support for engagement with the counter support to permit pivoting of the clamping profile about the pivot center. The flange and assembly pocket extend in a direction forming an angle of from 0° to 180° with the plane of the fabric and the assembly pocket has an inner stop for the bar, the stop spaced from the opening. The depth of the assembly pocket is less than the width of the bar so that an outer edge of the bar is located at a distance from the opening. The fabric extends around the outer edge of the bar and over a free edge of the flange in order in fabric stretched state to press the bar (with the edge portion of the fabric wrapped around it) against the stop.

20 Claims, 2 Drawing Sheets

FABRIC SIGN WITH TENSIONING MEANS

BACKGROUND AND SUMMARY OF THE INVENTION

The present invention relates to a sign comprising a stand; two pairs of first and second parallel support elements secured to the stand; a fabric with edge sections and between them a sign surface for information, extending in a plane between the support elements, and bars around which the edge portion of the fabric are wrapped and by means of which bars the edge portions of the fabric are detachably joined to the support elements, at least the first support element in each pair of support elements comprising a frame profile connected to the stand, and a clamping profile to support said bar provided with said edge portion of the fabric, said frame profile being provided with at least one counter support arranged at an outer edge portion of the frame profile located near the plane of the fabric in order to form a center of pivot for the clamping profile, the latter being provided with a flange arranged at an outer edge part of the clamping profile located near the plane of the fabric and defining an assembly pocket for receipt of the bar with the edge portion of the fabric wrapped around it via an opening, the clamping profile also being provided with a support member arranged to be brought into engagement with said counter support to permit pivoting of the clamping profile in relation to the frame profile about said center of pivot to a final position behind the plane of the fabric while clamping the fabric in relation to the second one of the two support elements, said second support element comprising a flange and an assembly pocket formed thereby and having the same shapes and functions as the equivalent elements of the first support element.

The European patents EP-0 114 453 and EP-0 268 308 describe signs in which the outer edges of the fabric are wrapped around retaining bars which are thereafter inserted in a recess in each of a plurality of fabric-retaining elements adjustably secured by bolts to the rod-shaped frame profiles. When the bolts extending through a vertical flange on each fabric-retaining element are tightened, the fabric is stretched. The frame-profile rods are provided with a longitudinal slit facing the fabric, the opposing sides of the slit having longitudinal grooves or ridges to provide a grip for the thread of each bolt. Such an arrangement for tensioning the fabric requires holes for the bolts to be drilled or punched in the flanges of the fabric-retaining elements, as well as the use of bolts requiring a certain amount of time for assembly and adding considerably to the material and assembly costs of a tension-fabric sign.

Signs with a different system of frame profile rods are sold under the name of Signcomp Tensioning System by Designtone Limited, England. The design of the frame profile rods here is even more complicated and includes at least one, but in some case two, longitudinal closed channels, which makes them expensive to manufacture. When the fabric is to be tensioned its edge is folded over a bar, short in relation to the length of the fabric, having a shallow U-shaped cross section, and an extremely complicated clip is snapped over it. The ends of the clip are provided with longitudinal teeth and are intended to be inserted laterally into a longitudinal open channel arranged in the frame profile rod. The cross-sectional dimensions of the channel are designed to suit the clip and one side of the channel is provided with teeth or ridges to cooperate with the teeth on the clip. The fabric is tensioned by pressing the clip into the open channel with the aid of a tensioning tool, and the tension in the fabric inclines the clip in the channel so that the fabric is firmly clamped between the clip and the opposing side of the channel.

Signs with a similar sign assembly are known through the patent specifications U.S. Pat. No. 4,937,961 and U.S. Pat. No. 5,033,216. However, the clips are manufactured by punching a blank out of resilient sheet metal and bending the punched blank. Instead of the longitudinal teeth at the ends of the clips, a fold bent along the entire length has the same function. Furthermore, the relatively short strip with shallow U-shaped cross section has instead a substantially rectangular cross section with one long side edge symmetrically bevelled and the other surfaces having longitudinal ridges located close together.

The patent U.S. Pat. No. 4,265,039 describes a sign with support elements, each of which has a plurality of short clamping devices and cooperating locking devices. Each clamping device is provided with an assembly pocket of circular form and an opening directed obliquely to the plane of the fabric. The opening is defined by two opposing flanges and its width is less than the thickness of the locking device, the latter thereby being retained inside the assembly pocket. The locking device consists of a cylindrical sleeve to be surrounded by an edge portion of the fabric which runs in to and out of the assembly pocket to be firmly clamped by the sleeve against the flanges when the sheet is tensioned. The locking sleeve is inserted into the assembly pocket from the side. The arrangement entails a complicated assembly of first the edge portions of the fabric and then the locking sleeves which are inserted in folds of the edge portions of the fabric which are difficult to maintain until the locking sleeves are in their operative positions. It will be seen that the tension force will be unevenly distributed along the fabric since it is clamped pointwise and not continuously, the fabric thus having folds or wavy portions. The arrangement also entails complicated retensioning of the fabric since it must be released pointwise at each locking sleeve which must be disengaged from its operative position, i.e. completely removed from the fabric and assembly pocket. The assembly procedure cannot be automated for a sign described in this U.S. patent.

Purely generally it can be stated that tension-fabric signs have been known for several decades. However, it is only recently that they have begun to be used more generally since both the fabric material and the assembly system for tensioning the fabrics have been improved. However, the known assembly systems and the frame profile rods used for them are relatively complicated and this is reflected in the cost of a finished tension-fabric sign. The work of retensioning the fabrics is also complicated.

The object of the present invention is to provide a sign enabling lower manufacturing and assembly costs, simpler retensioning of the fabric and having continuous engagement between fabric and clamping profiles so that the fabric remains uniformly tensioned.

The sign according to the present invention is characterized in that in its said final position the flange and assembly pocket of the clamping profile extend in a direction forming an angle of from 0° to 180° with the plane of the fabric; that the assembly pocket has an inner stop for the bar with the edge portion of the fabric wrapped around it spaced from the opening; that the depth of the assembly pocket, measured between the opening and the stop is less than the width of the bar so that an outer edge of the bar is located at a predetermined distance from and outside the opening; and that the fabric is arranged so that a section thereof extends around the outer edge of the bar and over a free edge of the flange in order in stretched state to press the bar with the edge portion of the fabric wrapped around it against the stop to clamp the edge portion of the fabric between the bar and the stop.

DETAILED DESCRIPTION OF THE DRAWINGS

Figure 1:
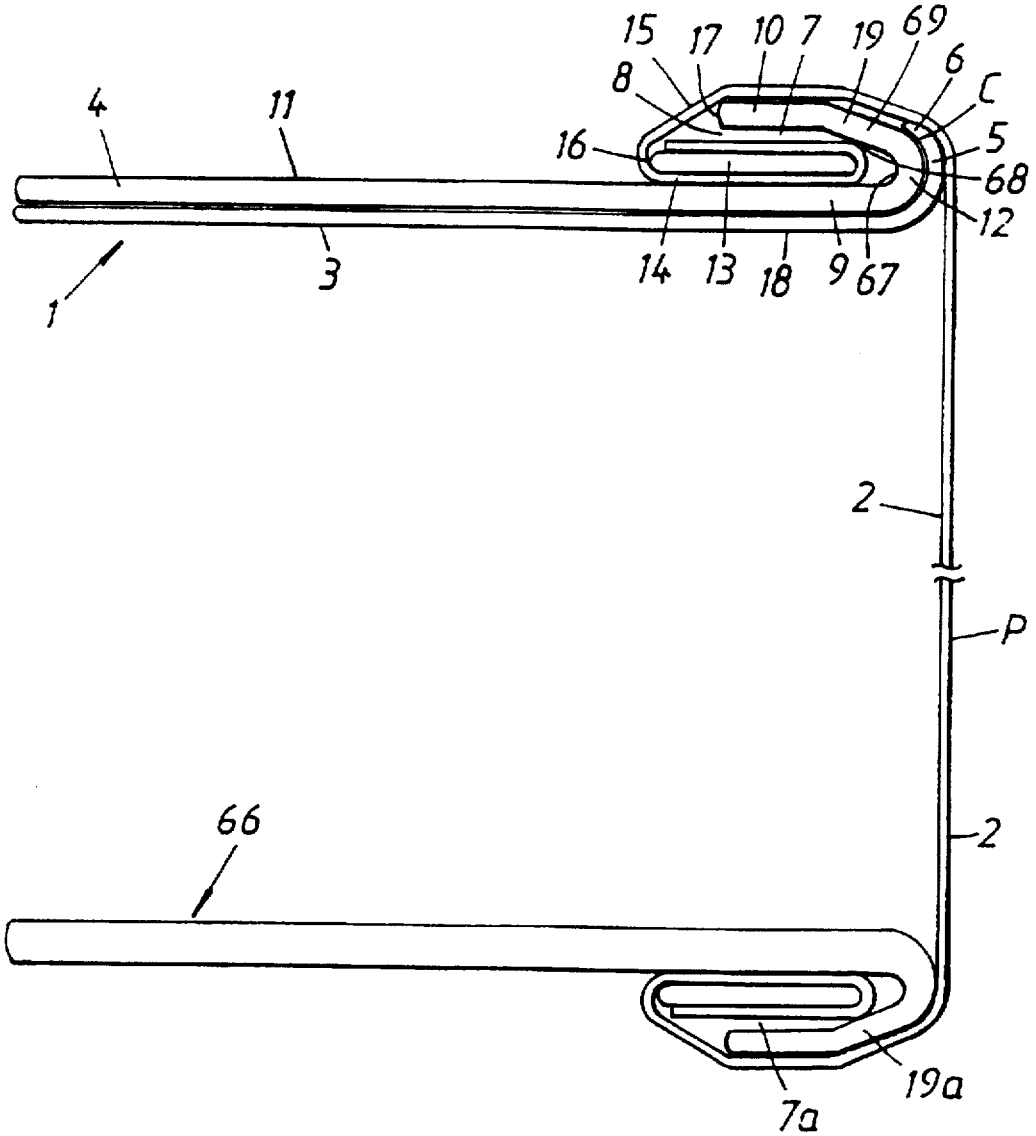
FIG. 1 is an end view of a part of a sign according to a first embodiment of the invention.

With reference to FIG. 1 it is shown therein a part, which may be a front part of a sign comprising a stand (not shown), a first pair of horizontal, parallel elongate first and second support elements 1, 66 carried by the stand, and a fabric 2 extending in a plane P between the two support elements 1, 66, on which the fabric is assembled in stretched state. The support elements 1, 66 are connected at the ends to the vertical, parallel support elements (not shown) of a second pair, thus forming a uniform frame. The upper support element 1 comprises a frame profile 3, a clamping profile 4 and a member (not shown) for locking the clamping profile 4 to the frame profile 3. The frame profile 3 has a plane form and is provided with a counter support 5 forming a center of pivot C for the clamping profile 4. The counter support 5 constitutes an extension of the outer edge portion 18 of the frame profile 3, said extension being curved so that the free edge 6 of the counter support 5 faces away from the plane P of the fabric and a channel is formed to retain the clamping profile 4 against the frame section 3. The clamping profile 4 has a plane form and is provided with an assembly pocket 7 which has its opening 8 facing away from the plane P of the fabric 2, seen in the final position of the clamping profile when maximum tension force is obtained. The assembly pocket 7, which has a bottom 67 is formed by a flange 19 which constitutes an extension of the outer edge portion 9 of the clamping profile 4, the flange 19 thus being bent backwards and having a plane section 10 which is suitably parallel to the waist section 11 of the clamping profile 4, and a bent section 12 adjusted to the curvature of the counter support 5 and forming a support member. The assembly pocket 7 has an inner stop located some distance from the opening 8. The stop may be formed by the actual bottom 67 of the assembly pocket but since such a stop is non-yielding a resilient stop is preferred for most applications. In the embodiment shown in FIG. 1 this is formed by an inner constriction 68 in the assembly pocket 7 and is spaced from the bottom 67. The constriction is formed by an inner inclined surface of an inclined section 69 extending between said straight and curved sections 10, 12.

The fabric 2 is intended to be clamped to each support element 1 by means of a locking member in the form of an elongate bar 13, around which an edge portion 14 of the fabric 2 is intended to be wrapped as shown in FIG. 1. The depth of the assembly pocket 7, measured between the opening 8 and the constriction 68, is less than the width of the bar 13 so that a section 15 of the fabric 2 extends around the outer edge 16 to the free edge 17 of the flange 19 in the direction obliquely towards the extended plane P of the fabric 2. The tension force in the fabric 2 will thus work against the outer edge 16 of the bar 13, thereby pressing the bar 13 into the assembly pocket 7 and clamping the fabric 2 between the bar and the curved section 12 of the flange 19. A self-locking effect is thus produced and this effect increases proportionally with increasing tension force in the fabric 2. The shown embodiment with an inclined surface 68 is preferred since, due to the wedge action, it retains the bar 13 with the wrapped edge portion 14 of the fabric during the initial stages of assembly before the fabric 2 comes under tension, and also since, when the fabric 2 is subsequently in stretched state and is subjected to external strain, such as strong winds, there is less risk of the fabric tearing since the bar can be pressed further into the assembly pocket when the tension in the fabric temporarily increases, thanks to the fact that the stop 68 is resilient instead of non-yielding. The bar 13 with the edge portion 14 of the fabric wrapped around it can easily be inserted into the assembly pocket 7 via the opening 8 along the entire length thereof, i.e. perpendicularly to the opening, and without obstruction.

During assembly the bar 13 with the edge portion 14 of the fabric wrapped around it is inserted into the assembly pocket 7 of the clamping profile 4, and the clamping profile 4 is moved towards the frame profile 3 so that it forms an acute angle therewith and so that its flange 19 is brought into abutment against the counter support 5 of the frame profile 3, after which the clamping profile 4 is pressed down towards the frame profile 3 with a pivoting movement about the centre of pivot C of the counter support 5. The clamping profile 4 functions as a lever, thereby producing increased tension in the fabric 2 when the clamping profile 4 is pressed down against the frame profile 3. If additional tension is desired, the clamping profile 4 is turned back and the bar 13 removed from the assembly pocket 7 through the opening 8. The bar 13 is then turned a half revolution so that another section of the edge portion 14 of the fabric is wrapped around the bar 13 and the clamping operation is repeated. It is assumed that the opposite edge portion of the fabric 2 has already been secured to the other support element 66. The clamping profile 4 and the visible edge portion of the fabric may then be covered by a cover profile (not shown), the cover profile and clamping profile 4 then being secured to the frame profile 3 by suitable attachment means (not shown), e.g. screws.

Figure 2:
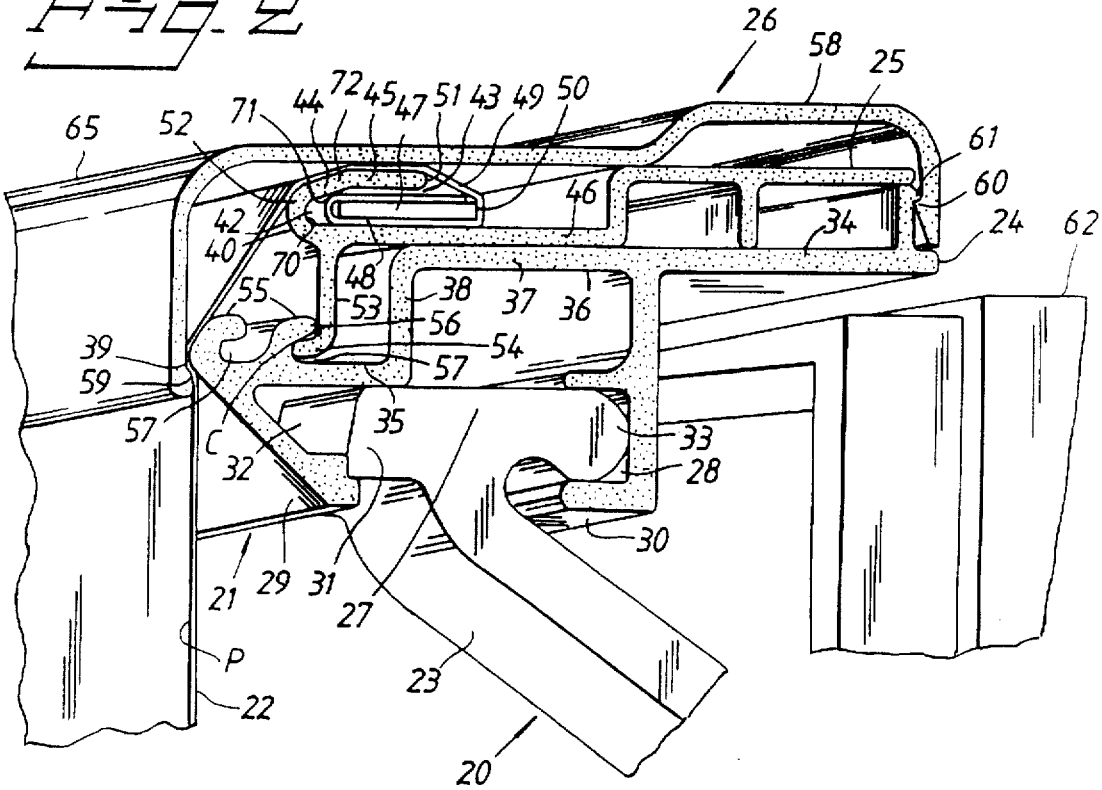
FIG. 2 is a perspective view of an end portion of parts of a sign according to a second embodiment of the invention.

With reference to FIG. 2 it is shown therein front and rear parts 62, 65 of a sign comprising a stand 20, a support element 21 carried by the stand 20 and included in a first pair of horizontal, parallel support elements, only one of which is shown, and a fabric 22 extending in a plane P between the two support elements 21 on which the fabric is mounted in stretched state. The ends of the two support elements are joined to the vertical, parallel support elements (not shown) of a second pair, thereby forming a uniform frame which is secured to the rear part 62 of the sign. In the embodiment shown in FIG. 2 the stand consists of a plurality of brackets 23 and a plurality of assembly tubes (not shown), each assembly tube carrying two brackets 23 (a lower and an upper one). The upper support element 21 comprises a frame profile 24, a clamping profile 25 and means 26 for locking the clamping section 25 to the frame profile 24. Each bracket 23 has a foot 27 for receipt in an internal groove 28 of the frame profile 24 in order to fix the support element 21 firmly to the bracket 23. Said groove 28 is defined outwardly by the opposing outer and inner flanges 29, 30 of the frame profile 24. The heel 31 of the foot 27 has an inclined surface 32 which, during assembly, slides against the outer flange 29 of the frame profile 24 so that, by means of a relative turning movement about its toe section 33, the foot 27 can be pressed into the groove 28 and finally locked in position by the flange 29 snapping in behind the heel 31 of the foot 27.

The frame profile 24 has an inner edge part 34 facing away from the plane P of the fabric, an outer edge part 35 facing towards the plane P of the fabric and a waist part 36 extending between said edge parts 34, 35. In the embodiment shown in FIG. 2 the edge parts 34, 35 are displaced so that they lie in different planes and the waist part 36 thus has a first main section 37 located in the same plane as the inner edge part 34 with no visible break between, and a second, smaller section 38 forming a right angle with the main section 37. The outer edge part 35 is parallel with the main section 37. Said outer flange 29 which, together with the inner flange 30, defines said internal groove 28 for the foot 27 of the bracket, extends obliquely down from the outer edge part 35 in the direction away from the plane P of the fabric 22. The outer edge part 35 has a free side edge 39 which is rounded and forms an edge over which the fabric 22 is bent, the fabric extending in said plane P between the frame profiles 24 of the two support elements 21. The clamping profile 25 is provided with an assembly pocket 42 with its opening 43 facing away from the plane P of the fabric, viewed in the final position of the clamping profile, when maximum tension force has been achieved. The assembly pocket 42, which has a bottom 70, is formed by the outer edge part 40 of the clamping profile 25 which is bent backwards in a flange 44 having a plane section 45 that is suitably parallel with a plane waist part 46 of the clamping profile 25, and a curved section 52. The assembly pocket 42 is thus located in a plane at right angles to the plane of the fabric 22. The assembly pocket 42 has an inner stop spaced from the opening 43. The stop may be formed by the actual bottom 70 of the assembly pocket but since such a stop is non-yielding a resilient stop is preferred for most applications. In the embodiment shown in FIG. 2 this is formed by an inner constriction 71 in the assembly pocket 42 and is spaced from the bottom 70. The constriction is formed by an inner inclined surface of an inclined section 72 extending between said plane and curved sections 45, 52.

The fabric 22 is intended to be clamped to each support element 21 by means of a locking member in the form of an elongate bar 47, around which an edge portion 48 of the fabric 22 is designed to be wrapped as shown in FIG. 2. The depth of the assembly pocket 42, measured between the opening 43 and the constriction 71, is less than the width of the bar 47 so that a section 49 of the fabric 22 extends from the outer edge 50 of the bar 47 to the free edge 51 of the flange 44 in a direction obliquely to the extended plane P of the fabric 22. A tension force in the fabric 22 will thus work against the outer edge 50 of the bar 47, thereby pressing the bar 47 into the assembly pocket 42 and clamping the fabric 22 between the bar and the curved section 52 of the flange 44. A self-locking effect is thus produced and this effect increases proportionally with increasing tension force in the fabric 22. The shown embodiment with an inclined surface 71 is preferred since, due to the wedge action, it retains the bar 47 with the edge portion 48 of the fabric wrapped around it during the initial stages of assembly before the fabric 22 comes under tension, and also since, when the fabric 22 is subsequently in stretched state and is subjected to external strain, such as strong winds, there is less risk of the fabric tearing since the bar can be pressed further into the assembly pocket when the tension in the fabric temporarily increases, thanks to the fact that the stop 71 is resilient instead of non-yielding. The bar 47 with the edge portion 14 of the fabric wrapped around it can easily be inserted into the assembly pocket 42 via the opening 43 along the entire length thereof, i.e. perpendicularly to the opening, and without obstruction.

The clamping profile 25 is also provided with a support member in the form of a support flange 53 extending from the plane waist part 46 in the vicinity of the flange 44 and on the side of the waist part 46 facing away from said flange 44. The support flange 53 forms a right angle with the waist part 46 and its free end portion 54 is bent to form an engagement foot. The frame profile 24 has two counter supports 55 arranged on the outer edge part 35, each forming a center of pivot C for the clamping profile 25. The counter support 55 is shaped as a curved flange, the free end edge of which is directed backwards away from the plane P of the fabric 22 so that a groove 57 is formed inside the flange 55 for receipt of the engagement foot 54 of the clamping profile 25. As can be seen in FIG. 2, the two counter supports 55 are arranged one after the other.

During assembly the bar 47 with the edge portion 48 of the fabric wrapped around it is inserted into the assembly pocket 42 of the clamping profile 25, and the support flange 53 is brought into engagement with, e.g. the outermost of the two counter supports 55 by the engagement foot 54 being inserted into the groove 57 of the counter support 55. In this initial stage the waist part 46 of the clamping profile 25 forms an acute angle with the waist part 36 of the frame profile 24. The clamping profile 25 is then pressed towards the frame profile 24 with a pivoting movement about the center of pivot C of the counter support 55. The clamping profile 25 functions as a lever, thereby producing increased tension in the fabric. If additional tension is desired, the clamping profile 25 is turned back and the bar 53 is moved to the next groove 57 to engage with the second counter support 55 and the clamping operation is repeated, so that the tension state shown in FIG. 2 is achieved. It is assumed that the opposite edge portion (not shown) of the fabric 22 has already been secured to the other (not shown) of the two support elements 21. Additionally or alternatively the bar 47 may be removed from the assembly pocket 42 through the opening 43 and another section of the fabric can be wrapped around it as described earlier for the embodiment shown in FIG. 1.

Said members 26 for locking the clamping profile 25 to the frame profile 24 comprise a cover profile 58 having edge portion with inwardly turned beadings 59, 60 for engagement with in the one case the free side edge 39 of the frame profile, clamping the fabric 22 therebetween, and in the other case with an outwardly directed bead 61 on the inner edge part 34 of the frame profile 24. The locking members 26 also suitably include loose attachment means such as screws screwed into the frame profile 24 and securing the cover profile 58 and clamping profile 25 to the frame profile 24. The front part 65 of the sign assembled in this manner is then screwed to the rear part 62 to produce the finished sign, the rear part 62 suitably containing light fittings for illumination of the fabric 22 in order to obtain an illuminated sign. In an alternative embodiment, not shown, the frame profile is provided with a U-shaped channel located at the inner edge of the frame profile and facing inwardly towards the plane of the fabric for receipt of a plane end part of the cover profile in order to retain it. In this case the support flange is shortened and the waist part 46 of the clamping profile is located closer to the groove 28 of the frame profile, the main section 37 having been moved down on a level with the edge part 35.

Figure 3:
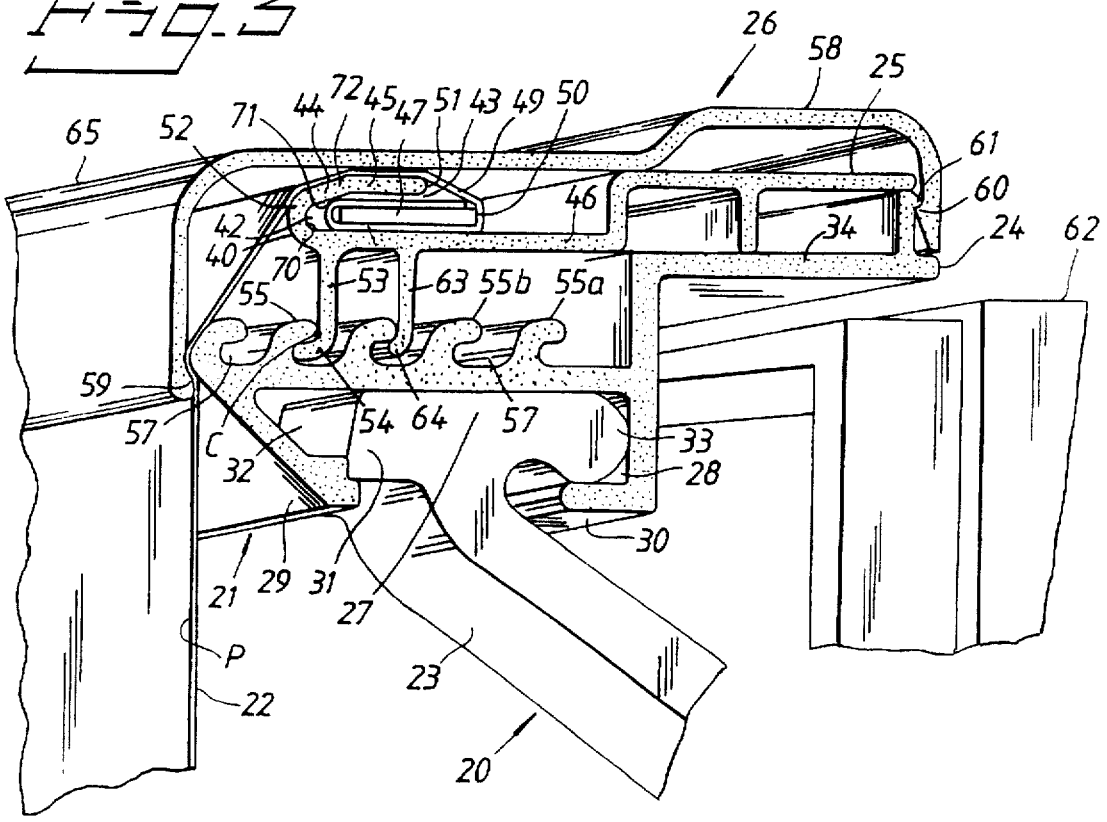
FIG. 3 is a perspective view of an end portion of parts of a sign according to a third embodiment of the invention.

With reference to FIG. 3 it is shown therein rear and front parts 62, 65 of a sign similar to that shown in FIG. 2, except that the frame profile 24 has been provided with even more counter supports 55 defining grooves 57 for the receipt of the support flange 53 of the clamping profile 25. Thereby it is possible to repeat the tensioning operation in additional steps until sufficient tension in the fabric is obtained. The clamping profile 25 is also provided with a locking flange 63 which is parallel to the support flange 53 and located outside this at a distance corresponding to the distance between two counter supports 55 on the frame profile 24. The free end portion of the locking flange 63 is in the form of an outwardly directed bead 64 arranged to be brought into locking engagement with a counter support 55 behind it when the clamping profile 25 is brought to abutment with the frame profile 24, as shown in FIG. 3. The innermost counter support 55*a* only cooperates in a locking function with the locking flange 63 when the support flange 53 is in engagement with the fourth counter support 55*b*.

The second support element may have the same shape as the described first support element 1, 21. However, it can be considerably simplified by omitting a special clamping profile, the essential element of which for securing the fabric is instead formed in the uniform support element as shown in FIG. 1. The other support element 66 thus in itself consists of a frame profile to secure the fabric and comprises a flange 19*a* and an assembly pocket 7*a* defined by the flange. These parts have the same shapes and functions as the equivalent elements 19 and 7, respectively, in the first support element 1. According to FIG. 1 the simplified support element 66 is arranged lowermost. However, it is normally arranged as an upper support element and the support element 1 provided with the clamping profile is then the lower support element. According to another embodiment of the second support element it comprises a clamping device of any type whatsoever, e.g. a clamping profile of the type described, but arranged to be displaced in its plane in order to achieve the clamping effect, and secured by means of toothed engagement between opposing profile surfaces, for instance.

The bar 13, 47 has an oblong cross section, preferably rectangular cross section, with essentially greater length than width (as regards the bar: essentially greater width than thickness). The bar is made of a suitable plastic material. It is bending resistant in cross section but flexible longitudinally so it can be bent to a roll. It is preferably attached to the fabric by suitable attachment means, preferably glue. This attachment is preferably effected when the fabric is prepared for delivery, in which case the finished unit of fabric and bars is rolled up for delivery to the assembly site where it is to be used. Thanks to the design of the support elements with assembly pockets 7, 42 accessible through free, wide openings 8, 43 from a direction facing the plane of the fabric and from a position behind the plane of the fabric along the entire length of the assembly pocket 7, 42 from end to end, the unit of fabric and bars can be assembled using a tool carrying this roll unit which is moved along the two horizontal support elements 1, 66; 21 while the upper edge portion of the fabric, glued to the bar and wrapped around it, is automatically fed into the upper assembly pocket 7, 42 when the assembly tool with the bar-fabric unit is moved along the support elements.

The bar used for mounting the fabric can be supplied in any lengths. However, the length of each piece is preferably greater than 0.5 m. Bars several meters in length, e.g. up to 7–8 m, may advantageously be used, depending on the delivery and storage facilities.

The term "profile" in the various contexts means an elongate, continuous, stable construction element having the same cross-sectional shape in all cross sections taken between its ends. The length of each profile corresponds to the length and height, respectively, of the sign. The profiles are normally produced by means of extrusion, in any case when the shapes are as complicated as in the embodiments shown in FIGS. 2 and 3. For the embodiment according to FIG. 1 the profiles can be produced by bending a rigid sheet metal blank.

In the embodiments shown the flange 19; 44 and assembly pocket 7; 42 extend in a direction perpendicular to the plane P of the fabric, viewed in the final position of the clamping profile 4; 25, i.e. when maximum tension force in the fabric has been achieved. Such a substantially perpendicular alignment is particularly preferred for large signs, i.e. several meters in length, since no building height exists. If the alignment generally is 0°–180°, the building height will extend outside the 90° angle, which can be accepted for smaller signs.

We claim:

1. A sign comprising:

a stand having two pairs of first and second parallel support elements secured thereto;

a fabric having edge portions, and an information-containing sign surface between said edge portions, said sign surface extending in a plane between said support elements;

a plurality of elongated bars for detachably joining said fabric to said support elements, said edge portions of said fabric wrapped around said bars, and said bars received by said support elements, each of said bars having a width, and an outer edge;

each of said first of said support elements in each pair of support elements comprising a frame profile connected to said stand, and a clamping profile to support one of said bars;

said frame profile including at least one counter support disposed at an outer edge portion of said frame profile and positioned near said plane, and providing a pivot center for said clamping profile;

said clamping profile including a flange at an outer edge part thereof positioned adjacent said fabric plane, having a free edge, and defining a first assembly pocket with an opening for receipt of one of said bars and an inner stop, an edge portion of said fabric wrapped around said bar and remote from said opening; said assembly pocket having a depth, between said opening and said stop, said depth being less than said width of said bar so that said outer edge of said bar is positioned a predetermined distance from and exterior of said first assembly pocket and positioned so that a section of said fabric wraps around said outer edge of said bar and over said free edge of said flange so that said fabric is stretched and presses said bar against said stop to clamp said edge portion of said fabric between said bar and said stop;

a support member positioned for engagement with said counter support to permit pivoting of said clamping profile with respect to said frame profile about said pivot center to a final position behind said fabric plane to tension said fabric while clamping said fabric to said second support element, with said flange and said assembly pocket extending in a direction forming an angle of from 0–180° with respect to said fabric plane; and said second support element comprising a flange at an outer edge part thereof positioned adjacent said fabric plane and defining a second assembly pocket, substantially identical to said first assembly pocket, for receipt of one of said bars.

2. A sign as recited in claim 1 wherein each of said inner stops is formed by a bottom portion of each of corresponding assembly pocket.

3. A sign as recited in claim 2 wherein each said flange of each of said clamping profiles comprises a bent extension of said outer edge part of each corresponding clamping profile; and wherein each said flange of each of said clamping profiles has a curved section that forms each corresponding support member for each corresponding counter support; and wherein each said counter support comprises a bent extension of said outer edge portion of each corresponding frame profile.

4. A sign as recited in claim 2 wherein each said support member comprises a separate support flange extending from said outer edge part of each corresponding clamping profile in a direction distinct from a direction that each said flange forming each said first assembly pocket extends.

5. A sign as recited in claim 1 wherein each of said inner stops is formed by an inner constriction in each corresponding assembly pocket, each said inner constriction spaced from a bottom portion of each corresponding assembly pocket.

6. A sign as recited in claim 5 wherein each said inner constriction is formed by an inner inclined surface of an incline section of each said flange.

7. A sign as recited in claim 6 wherein each said flange of each of said clamping profiles comprises a bent extension of said outer edge part of each corresponding clamping profile; and wherein each said flange of each of said clamping profiles has a curved section that forms each corresponding support member for each corresponding counter support; and wherein each said counter support comprises a bent extension of said outer edge portion of each corresponding frame profile.

8. A sign as recited in claim 6 wherein each said support member comprises a separate support flange extending from said outer edge part of each corresponding clamping profile in a direction distinct from a direction that each said flange forming each said first assembly pocket extends.

9. A sign as recited in claim 1 wherein each said flange of each of said clamping profiles comprises a bent extension of said outer edge part of each corresponding clamping profile; and wherein each said flange has a curved section that forms each corresponding support member for each corresponding counter support; and wherein each said counter support comprises a bent extension of said outer edge portion of each corresponding frame profile.

10. A sign as recited in claim 9 wherein when said fabric is fully stretched, each said flange and each assembly pocket opening extends and faces away from said fabric plane.

11. A sign as recited in claim 1 wherein each said support member comprises a separate support flange extending from said outer edge part of each corresponding clamping profile in a direction distinct from a direction that each said flange forming each said first assembly pocket extends.

12. A sign as recited in claim 11 wherein each said support flange forms substantially a right angle to said outer edge part of each corresponding clamping profile.

13. A sign as recited in claim 1 wherein when said fabric is fully stretched, each said flange and each assembly pocket opening extends and faces away from said fabric plane.

14. A sign as recited in claim 13 wherein each said flange extends and each said assembly pocket opening opens in a direction substantially perpendicular to said fabric plane.

15. A sign as recited in claim 1 wherein each said bar is positively secured to said fabric at each edge portion of said fabric.

16. A sign as recited in claim 15 wherein at least one of said bars is glued to said fabric.

17. A sign as recited in claim 15 wherein each said bar is elongated in a dimension of elongation, and is bending resistant in a dimension transverse to said dimension of elongation, and flexible in said dimension of elongation; and wherein said plurality of bars and fabric form a roll which may be rolled in a rolling action along said sign by an assembly tool which automatically inserts a bar in an assembly pocket during said rolling action.

18. A sign as recited in claim 1 wherein each of said bars has a rectangular cross-section with a greater width than thickness.

19. A sign as recited in claim 18 wherein each of said bars is formed by at least one piece, each piece having a length of at least 0.5 meters.

20. A sign as recited in claim 1 wherein each of said bars is formed by at least one piece, each piece having a length of at least 0.5 meters.

* * * * *